US007861963B2

(12) United States Patent
Mazoyer et al.

(10) Patent No.: US 7,861,963 B2
(45) Date of Patent: Jan. 4, 2011

(54) THREAD ACCUMULATION DEVICE

(75) Inventors: Michel Mazoyer, Pfastatt (FR); Philippe Massotte, Gueberschwiher (FR); Didier Thibault, Bru (FR)

(73) Assignee: Superba, Mulhouse (FR)

( * ) Notice: Subject to any disclaimer, the term of this patent is extended or adjusted under 35 U.S.C. 154(b) by 173 days.

(21) Appl. No.: 11/952,344

(22) Filed: Dec. 7, 2007

(65) Prior Publication Data

US 2008/0163470 A1 Jul. 10, 2008

Related U.S. Application Data

(60) Provisional application No. 60/881,159, filed on Jan. 19, 2007.

(30) Foreign Application Priority Data

Jan. 4, 2007 (FR) ..... 07 52526

(51) Int. Cl.
*B65H 59/38* (2006.01)

(52) U.S. Cl. ..... 242/418.1

(58) Field of Classification Search ..... 242/418.1, 242/413.3–413.8, 473.4–474.2, 552, 421.5–421.9, 242/420.3, 420.6, 419.1; 226/36–44, 118.1–118.5, 226/104–107, 1; 28/220, 262, 263, 247, 28/250

See application file for complete search history.

(56) References Cited

U.S. PATENT DOCUMENTS

| | | | | |
|---|---|---|---|---|
| 4,609,336 | A * | 9/1986 | Stevenson et al. | 425/135 |
| 6,257,862 | B1 * | 7/2001 | Nissel | 425/377 |
| 6,516,942 | B2 * | 2/2003 | East | 198/830 |
| 2004/0026218 | A1 * | 2/2004 | Kotaki et al. | 198/825 |
| 2005/0194235 | A1 * | 9/2005 | Wilmo et al. | 198/494 |

FOREIGN PATENT DOCUMENTS

| | | |
|---|---|---|
| FR | 2 576 885 A | 8/1986 |
| GB | 2 274 119 A | 7/1994 |

OTHER PUBLICATIONS

French Search Report of FA 688638, date of mailing Jul. 9, 2007.

* cited by examiner

*Primary Examiner*—William E Dondero
(74) *Attorney, Agent, or Firm*—Young & Thompson

(57) ABSTRACT

A thread accumulation device includes a discharge chute (13) for receiving and guiding a strand that is formed by a thread take-up device and a carriage for taking up a thread spiral, guided on the discharge chute (13) and resting on the end of the strand of the side that is opposite to the thread take-up device. At the outlet of the thread take take-up device, the discharge chute (13) is equipped with a transport unit (16) that adapts to the inside shape of the discharge chute (13). The invention can be applied more particularly in the field of the textile industry, in particular the treatment of thread.

14 Claims, 2 Drawing Sheets

THREAD ACCUMULATION DEVICE

This relates to the field of the textile industry, in particular the treatment of thread, in particular by means of heat treatment machines that are now called heat-setting machines, as well as other lines of treatment or production, in which the thread is transported between different treatment stations, in which the speeds of advance can be different, and it has as its object a thread accumulation device.

BACKGROUND OF THE INVENTION

The machines for treating threads, used in the field of the textile industry, are often placed in a line to make possible different treatments of the textile threads continuously and thus to make possible a high yield resulting from a minimum number of interruptions of the process for production or treatment, for example for the sake of a machine change with modification of the speed of advance of the threads relative to the preceding or succeeding machines.

It is therefore advisable to ensure an intermediate storage of the threads to compensate for the speed differential that may exist between two thread treatment stations, so as to allow collision-free operation of a line for production and/or treatment.

For this purpose, a textile thread-accumulating device that uses a device for depositing threads in coils on the end of a longitudinal support and means for taking up said threads at the other end of this support is known by FR-A-2 576 885.

Such a device makes it possible to carry out a correct accumulation of threads, but it is not suitable for modern treatment and/or production lines whose very high operating speeds call for a significant accumulation capacity to take into account programmed cyclic interruptions or to make possible a smooth stopping of the line, i.e., with no significant impact requiring a very long reactivation time in the case of an accidental failure of a work station.

To prevent this drawback, it has been proposed to produce an accumulator device that consists essentially of a discharge chute, which, as an extension from the outlet, has an element for depositing a stranded-thread spiral, whose end that is opposite to the depositing element is guided in such a way as to be taken up and unwound by a downstream treatment or production station.

So as to regulate the speed and the tension of the strand during the unwinding, the discharge chute is equipped with a carriage that is guided parallel to the longitudinal axis of said discharge chute and that rests on the end of the strand of the side that is opposite to the depositing element, whereby this carriage is provided with strand guide means in the form of a guiding eyelet and/or a guiding and return bar. In addition, this carriage can be weighted in order to produce a support force on the head of the strand, at the outlet of the thread spiral, essentially to brake and monitor the strand during unwinding, i.e., to allow a certain tension of the thread spiral, as well as to obtain a predetermined strand density.

The devices of this type make possible, from the very fact of their constitution, an easy adaptation to the work conditions, i.e., that if a significant accumulation is to be produced, the only thing that needs to be done is to extend the discharge chute accordingly.

However, the accumulation devices of this type have the drawback of always having to be more or less inclined relative to the horizontal line to allow an effective action of the weighted carriage on the thread strand that is being formed and to ensure a correct tension of the thread spiral at the outlet of said carriage. In addition, taking into account this slope of the discharge chute, the vertical space that is occupied by these devices can become significant as the discharge chute is extended, and it then becomes necessary to provide for the operator elevated access means that extend over several levels, such as walkways, etc. High installation costs are the result.

In addition, the thread strand moves into the discharge chute by sliding into the latter and, starting from a certain length and based on the thread, the thus produced rubbing action against the wall of the discharge chute becomes significant, which, in combination with the action of the carriage, leads to an increase in the density of the strand.

This results in an impossibility of forming a homogeneous accumulation and a difficulty in taking up the thread spiral, such that the good operation of the treatment line may be affected. However, with the enhancement of the performance levels of the current treatment lines, the speed of taking up the threads increases proportionally and the adjustment of the take-up tension is difficult to carry out and takes too long because, to make this adjustment, the operator has to walk along the discharge-chute service walkway and install a ballast weight on the carriage. Consequently, the reaction time between the verification of a poor separation and the moment of the intervention that tends to modify the parameters of loads by means of the carriage is too long, and the action that is carried out runs the risk of being unsuitable.

In addition, the current increase of the speeds brings about a critical disadvantage for the safety of the operator. Actually, because of the tension of the threads, a break in the separation zone of the latter may have the consequence of forming a lasso-shaped loop that can hook onto the carriage, which can then be abruptly driven at the same speed as the threads and can be ejected from the discharge chute without the automatic safety devices being able to react.

SUMMARY OF THE INVENTION

This invention has as its object to eliminate these drawbacks by proposing a thread accumulation device whose vertical space that is occupied is reduced and which makes it possible to ensure a homogeneous accumulation of a stranded-thread spiral and an easy take-up of said thread spiral.

For this purpose, the thread accumulation device, which essentially consists of a discharge chute for receiving and guiding a strand that is formed by a thread take-up device and a carriage for taking up a thread spiral, guided parallel to the longitudinal axis of said discharge chute and resting on the end of the strand of the side that is opposite to the thread take-up device, is characterized in that the discharge chute is equipped, at the outlet of the thread take-up device, with a means of transport that is driven in synchronism with the speed with which the strand is formed.

BRIEF DESCRIPTION OF THE DRAWINGS

The invention will be better understood using the description below that relates to a preferred embodiment, given by way of nonlimiting example and explained with reference to the accompanying diagrammatic drawings, in which.

DETAILED DESCRIPTION OF THE PREFERRED EMBODIMENTS

Figure 1:
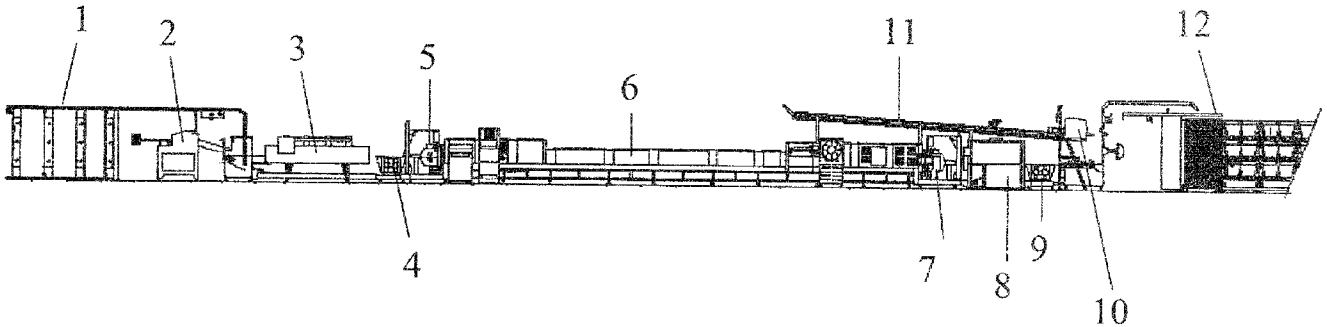
FIG. 1 is a lateral elevation view of a thread treatment line that comprises the thread accumulation device according to the invention.
Figure 2:
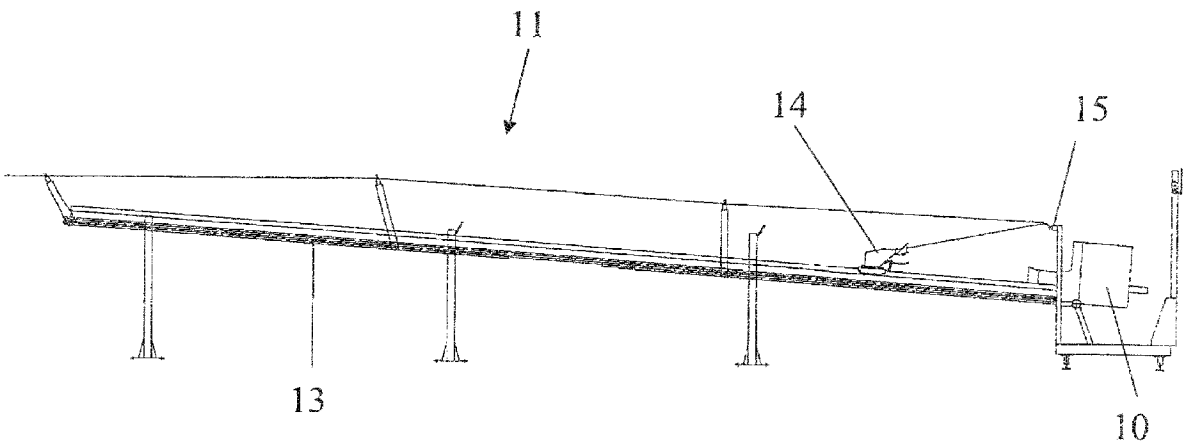
FIG. 2 is a lateral elevation view on an enlarged scale, showing the device according to the invention by extending a thread take-up device.

FIG. 1 of the accompanying drawings shows, by way of example, a heat-setting line that consists of a creel 1, of a head or a machine for curling 2 that makes it possible to deposit threads on a conveyor belt, of a steaming unit 3, and of a cooling unit 4 that is extended by a sealing head 5 of a heat-setting tunnel 6 that is equipped at its other end with an outlet sealing head 7 that empties into a drier 8, which is extended by a cooling device 9.

At the outlet of this device, the threads are taken up continuously by a thread take-up device 10 to be routed to a winder 12. Because the winder 12 operates intermittently to allow the doffing of the full spools and the installation of new empty spools, the treatment line is equipped—between the thread take-up device 10 and the winder 12—with a thread accumulation device 11.

Such a device 11, which essentially consists of a discharge chute 13 for receiving and guiding a strand that is formed by the thread take-up device 10 and a carriage 14 for taking up a thread spiral, guided parallel to the longitudinal axis of said discharge chute 13 that is equipped with a tension rail device 15 and that rests on the end of the strand of the side that is opposite to the thread take-up device 10, makes it possible to improve the efficiency of the treatment line and to ensure that the delicate threads that should not remain in the heat-setting tunnel 6 except for a limited time are preserved. It thus is possible, with each stop of the winder during doffing cycles, or following a breaking of thread or an activation of a tuft guard, therefore after the take-up of threads, that the heat-setting line continues to operate normally, i.e., without interruption, whereby the accumulation device 11 carries out a temporary storage of the thread that is produced, i.e., that acts as a buffer.

According to the invention, the discharge chute 13 of the thread accumulation device 11 is equipped, at the outlet of the thread take-up device 10, with a means of transport 16 that is driven in synchronism with the speed with which the strand is formed. Preferably, this means of transport 16 takes on the inside shape of the discharge chute 13 (FIGS. 3 and 4).

Figure 3:
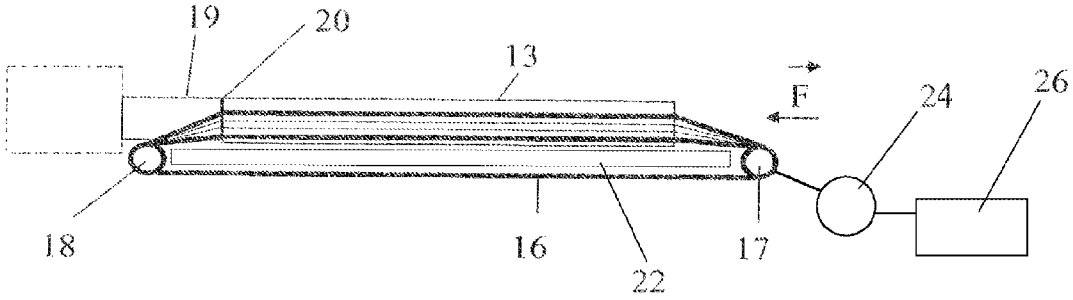
FIG. 3 is an enlarged partial view of FIG. 2, whereby the device is in horizontal position.
Figure 4:
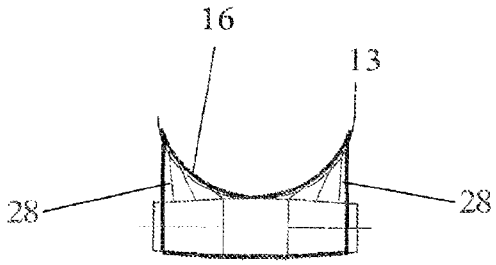
FIG. 4 is a view along F of FIG. 3.

As FIGS. 3 and 4 show, the means of transport 16 can advantageously be in the form of a closed-loop belt or a conveyor belt that is stretched between a driving roller 17 and a turning roller 18 that are placed at the ends of a support chassis 22 extending under the discharge spout 13, whereby the upper strands of the belt or conveyor belt have a curve corresponding to that of the discharge spout in order to adapt to its contour.

According to a characteristic of the invention, the support chassis 22 of the means of transport 16 has a length that is greater than the one of the discharge spout 13 of the thread accumulation device 11 and is provided at each end, respectively between the driving roller 17 and the turning roller 18 and the corresponding end of the discharge spout 13 with lateral means 28 of turning the edges of the belt or conveyor belt forming the means of transport 16, deflecting said edges upward, so as to impart to means 16 a cross-section that is identical to that of the discharge spout 13. These lateral turning means 28 of the belt consist of inclined ramps and/or rollers that are placed laterally to means 16, at each end of the latter.

Furthermore, the driving roller 17 and the turning roller 18 are advantageously in the form of bent rollers. Thus, the belt or the conveyor belt that forms the means of transport 16 can be diverted to the discharge chute 13 and adapted to the inside contour of the latter without undergoing any elastic deformation, whereby the elongation of the upper edges is compensated by the reduction of the diameter of the rollers 17 and 18 at their ends. It follows that the lower part of the conveyor belt or belt is fully applied against the rollers 17 and 18, whereby the length of the strands of the lower edges, which is shorter than that of the median strand, makes it possible to use extra length for the strands of the upper edges, such that the latter can be applied to the raised edges of the discharge chute 13 without additional tension.

According to another characteristic of the invention, the end of the support frame of the means of transport 16, turned toward the thread take-up device 10, advantageously extends under an intermediate discharge chute section 19 that is provided between the thread take-up device 10 and the corresponding end of the discharge chute 13. This intermediate discharge chute section 19 actually corresponds essentially to the space requirement of the holding blades of the thread spiral during the formation of the beginning of the strand to be deposited in the discharge chute 13. These holding blades, which extend the end of the thread take-up device 10, are known and their mode of operation is also known, such that an additional description concerning them is unnecessary.

Thus, the formation of the strand is carried out essentially in the zone of the intermediate discharge chute section 19 and the deformation of the upper part of the belt or conveyor belt that forms the means 16 is produced in this same zone, under said section 19, the belt or the conveyor belt, deformed along a section that corresponds to that of the discharge chute 13, emptying into said discharge chute 13 through a transverse slot 20 that is provided between said intermediate section 19 and the corresponding end of the discharge chute 13.

Because of the driving of the transport means 16, the strand that is formed at the outlet of the thread take-up device 10 can be transported over a great length of the discharge chute 13 without being affected by any adhesion force on the wall of the discharge chute 13, which would be due to the rubbing of the threads against said wall, whereby said threads are not in contact with the discharge chute 13.

This production of the discharge chute 13 therefore makes it possible to be completely free of the problems linked to the rubbing of the threads against the discharge chute, such that the latter can have a great, and even a very great, length without the mechanical characteristics of the strand thereby being affected by it and such that the thread separation tension can be kept constant.

According to another characteristic of the invention and as FIG. 3 of the accompanying drawings shows, the discharge chute 13 can be placed on the horizontal line. In the embodiment according to FIG. 3, the carriage 14 is not shown. In the case of such an arrangement on the horizontal line of the discharge chute 13, the carriage 14 can be simply guided parallel to the longitudinal axis of the discharge chute 13, and its movement can be controlled, for example, using a braking means and/or controlled drive that maintains a predetermined support pressure of the carriage 14 on the end of the strand or else using a device for applying the carriage against said end, in the form of a return means with a cable and a counterweight, with a pre-tightened hoist or with a brake motor, etc.

It is also possible, according to another variant embodiment of the invention, to produce the means of transport 16 in the form of parallel conveyor belts that are stretched between the driving roller 17 and the turning roller 18. In such a case, the lateral belts that form the means of transport 16 can be made longer than the central belts, such that the driving roller 17 and the turning roller 18 can be in the form of cylindrical rollers, whereby the change in configuration of the discharge chute 13 is ensured by the difference in length of said lateral belts, without them being subjected to additional tension.

The driving roller 17 for driving the means of transport 16 is coupled to a variable-speed reversible motor or to a reversible geared motor 24, which is controlled by an automatic control and command device 26, based on programmed data and signals obtained from control means of the strand being formed. In a known manner, such control means can be provided at the outlet of the thread take-up device 10 and the corresponding strand speed signals are taken into account by the calculating means of the automatic device to determine an optimal strand density and consequently to deliver a speed control signal for positive or negative driving of the means of transport 16.

Thanks to the invention, it is possible to very clearly improve the accumulation of threads in a treatment or production line by allowing the production of a homogeneous strand and an easy take-up of said thread spiral forming said strand, this by means of a device whose vertical space that is occupied can be reduced.

Actually, from the very fact of the monitoring of the movement of the strand, the guiding discharge chute of said strand can be placed on the horizontal line, such that the vertical space that it occupies is constant and can therefore be reduced to a minimum so as to allow the operator to act on the device from a uniform surface, regardless of the accumulation capacity of the device. In addition, the work of the operator is facilitated because it is no longer necessary to perform manual operations on the carriage 14 to adjust the thread separation tension, whereby the latter is monitored and adjusted continuously by means of the automatic device for monitoring the movement of the means of transport 16.

Of course, the invention is not limited to the embodiment that is described and shown in the accompanying drawings. Modifications remain possible, in particular from the viewpoint of the constitution of the various elements or by substitution of equivalent techniques, without thereby exceeding the field of protection of the invention.

The invention claimed is:

1. A thread accumulation device, comprising:

a discharge chute (13) for receiving and guiding a strand exiting a thread take-up device (10); and a carriage (14) for taking up a thread spiral, the carriage (14) guided parallel to a longitudinal axis of said discharge chute (13) and resting on an end of the strand of the side opposite to the thread take-up device (10), wherein, at an outlet of the thread take-up device (10), the discharge chute (13) includes a means for transporting (16) configured to be driven in synchronism with a speed of the strand exiting the thread take-up device (10), wherein the means for transporting (16) comprises a closed-loop or conveyor belt stretched between a driving roller (17) and a turning roller (18), and wherein an upper strand of the closed-loop or conveyor belt has an upwardly opening curve corresponding to an upwardly opening curve of the discharge chute (13) in order to adapt to a contour of said curve of the discharge chute (13).

2. The device according to claim 1, wherein an end of the transport means (16) extends under an intermediate discharge chute section (19) provided between the thread take-up device (10) and a corresponding end of the discharge chute (13).

3. The device according to claim 1, wherein the driving roller (17) and the turning roller (18) each comprise a frusto-conical portion, a radius at a first end of the frusto-conical portion being smaller than a radius of an opposite second end of the frusto-conical portion.

4. The device according to claim 1, wherein the discharge chute (13) is horizontal.

5. The device according to claim 1, wherein the means for transporting (16) comprises parallel conveyor belts stretched between the driving roller (17) and the turning roller (18).

6. The device according to claim 5, wherein lateral conveyor belts of the parallel conveyor belts are longer than central belts of the parallel conveyor belts, and the driving roller 17 and the turning roller (18) are are cylindrical.

7. The device according to claim 6, wherein the driving roller (17) for driving the means for transporting (16) is coupled to a variable-speed reversible motor or to a reversible geared motor, which is controlled by an automatic control and command device, based on programmed data and signals obtained from control means of the strand being formed.

8. The device according to claim 1, wherein the discharge chute (13) is horizontal.

9. The device according to claim 1, wherein the driving roller (17) and the turning roller (18) are placed at either ends of a support frame (22) of the means for transporting (16), the support frame (22) having a length that is greater than that of the discharge chute (13) and is provided between the driving roller (17) and the turning roller (18) and at an end of the discharge chute (13), the support frame (22) also having lateral means (28) for turning edges of the closed-loop or conveyor belt and deflecting said edges upward so as to impart to the means for transporting (16) a cross-section that is identical to a cross-section of the discharge chute (13).

10. The device according to claim 1, wherein an end of the support frame, turned toward the thread take-up device (10), extends under an intermediate discharge chute section (19) provided between the thread take-up device (10) and the end of the discharge chute (13).

11. The device according to claim 1, wherein the driving roller (17) is coupled to a driving motor (24) being one of a variable-speed reversible motor and a reversible geared motor, the driving motor being controlled by an automatic control and command device (26).

12. A thread accumulation device, comprising:

a discharge chute (13) for receiving and guiding a strand, the discharge chute (13) configured to operate with a first end of said discharge chute (13) at an outlet of a thread take-up device (10); and a carriage (14) configured to take up a thread spiral, the carriage configured to by guided parallel to a longitudinal axis of said discharge chute (13) and positioned at a second end of the discharge chute (13) opposite the first end, wherein the discharge chute (13) comprises a motorized transporting means (16) located at the first end configured to be driven in synchronism with a speed of the strand exiting the outlet of the thread take-up device (10) wherein the transporting means (16) comprises a closed-loop or conveyor belt stretched between a driving roller (17) and a turning roller (18), and wherein said discharge chute (13) has an upwardly opening contour, and an upper strand of the closed-loop or conveyor belt has an upwardly opening curve corresponding to the contour of said discharge chute (13) in order to adapt to the contour of said discharge chute (13).

13. The device according to claim 12, wherein the transporting means (16) is configured to conform to an inside shape of the discharge chute (13).

14. The device according to claim 12, wherein the driving roller (17) and the turning roller (18) each comprise frusto-conical end sections joined by a cylindrical mid-section, a radius at an end of either of the frusto-conical end sections being smaller than a radius of the mid-section.

* * * * *